US006557475B1

(12) United States Patent
Nygren et al.

(10) Patent No.: US 6,557,475 B1
(45) Date of Patent: May 6, 2003

(54) SEPARATION SYSTEM FOR A BOOSTER PAYLOAD FAIRING

(75) Inventors: William D. Nygren, Denver, CO (US); Scot Anderson, Conifer, CO (US)

(73) Assignee: Lockheed Martin Corporation, Bethesda, MD (US)

( * ) Notice: Subject to any disclaimer, the term of this patent is extended or adjusted under 35 U.S.C. 154(b) by 0 days.

(21) Appl. No.: 09/493,587

(22) Filed: Jan. 28, 2000

(51) Int. Cl.[7] ..... F42B 15/10; F42B 15/36
(52) U.S. Cl. ..... 102/377; 244/161; 292/33
(58) Field of Search ..... 102/377, 348, 102/357, 393; 244/158 R, 169, 172, 161; 292/32, 33, 34, 37, 158, 159, 131, 140, 11, 24, 341.17, 44

(56) References Cited

U.S. PATENT DOCUMENTS

| | | | | | |
|---|---|---|---|---|---|
| 1,398,636 | A | * | 11/1921 | Forlander | 292/341.17 |
| 1,493,526 | A | * | 5/1924 | Freysinger | 292/341.17 |
| 3,515,421 | A | * | 6/1970 | Poe et al. | 292/11 |
| 3,832,804 | A | * | 9/1974 | Goldsmith | 244/129.5 |
| 4,087,121 | A | * | 5/1978 | Davis | 292/139 |
| 5,046,426 | A | | 9/1991 | Julien et al. | 102/377 |
| 5,518,040 | A | * | 5/1996 | Rupflin | 139/57 |
| 5,743,492 | A | | 4/1998 | Chan et al. | 244/118.2 |

FOREIGN PATENT DOCUMENTS

| | | | |
|---|---|---|---|
| GB | 2275500 A | * | 8/1994 |
| JP | 355119538 A | * | 9/1980 |

* cited by examiner

*Primary Examiner*—Peter M. Poon
*Assistant Examiner*—Chad Copier
(74) *Attorney, Agent, or Firm*—Marsh Fischmann & Breyfogle LLP

(57) ABSTRACT

The invention is a separation system for releasably securing first and second structural members together along mating edges thereof. For example, the segments of a launch vehicle faring used to protect the payload until orbit is reached. In detail, the invention includes a plurality of latches with each latch including a male portion mounted in proximity the edge of the first structural member and a female portion mounted on the second structural member in proximity to the edge thereof. A locking device is mounted on the second structural member in proximity to the edge thereof, movable from a locked position securing the male portion to the female portion to a second position unlocking the male portion from the female portion. An actuation device is provided for sequentially moving the locking device of each latch from the first position to the second position, unlocking the male portions from the female portions of the plurality of latches.

10 Claims, 5 Drawing Sheets

FIG. 1
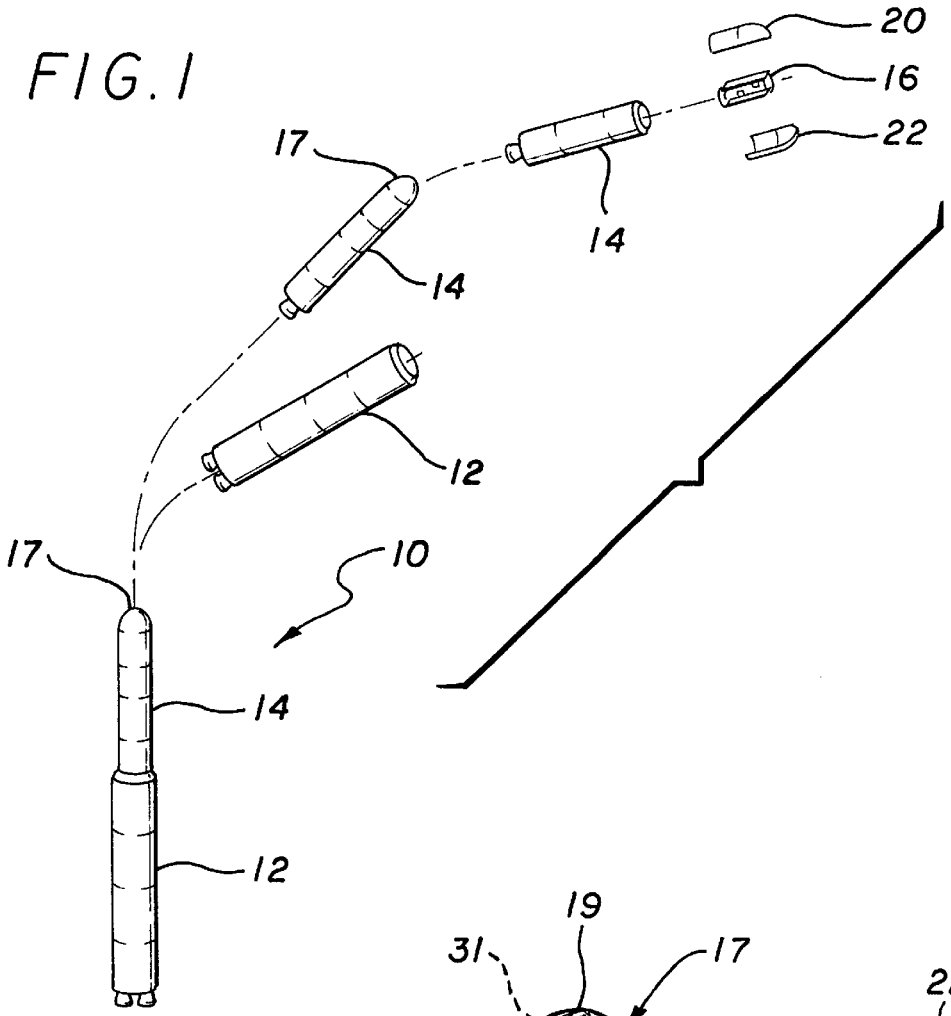
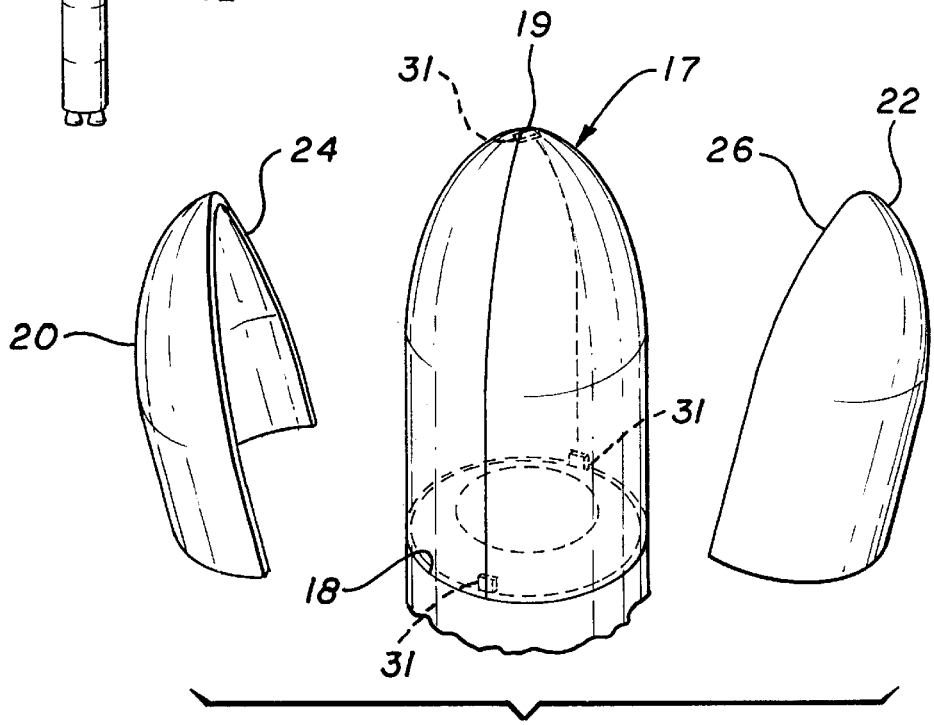
FIG. 2

SEPARATION SYSTEM FOR A BOOSTER PAYLOAD FAIRING

BACKGROUND OF THE INVENTION

1. Field of the Invention

The invention relates to the field of separation systems for missile payload fairings and the like and, in particular, to a separation system that reduces shock loads in the missile and payload.

2. Description of Related Art

The typical systems for mechanically securing segments of a payload fairing together use explosively actuated fasteners, such as explosive bolts and the like. Another type of explosive actuated system uses a metal coupling to join the segments of the fairing together. A tubular member is positioned next to or within the coupling. Upon ignition, the explosive expands the tubular member, which in turn fractures the coupling. Such a system is disclosed in U.S. Pat. No. 5,443,492 "Payload Housing And Assembly Joint For A Launch Vehicle" by A. L. Chan, et al.

However, pyrotechnic fasteners and the like, while well proven, can not be tested prior to use, thus must be assembled with great care. This makes them generally expensive to manufacture. Special storage areas must be set aside for any device containing explosives. They are always subject to inadvertent actuation, and, therefore, handled with great care. Additionally, they are particularly subject to ignition by electromagnetic interference (EMI) and thus must be protected by EMI shielding devices, which also raises the cost. Another disadvantage is that, due to the fact that the explosive charge can be ignited by exposure to high temperature, they have a limited environmental temperature range. One of the most important disadvantages is that upon actuation, most generate significant shock loads, which can damage nearby equipment.

Thus in order to eliminate the above disadvantages non-pyrotechnic designs have emerged. For example, U.S. Pat. No. 5,046,426 "Sequential Structural Separation System" by G. J. Julien, et al. uses a sequence of wires or foil strips attached by their ends to the edges of adjoining segments, thus securing them together. But when heated the wires or foils melt allowing the segments to separate. By varying the lengths of the wires or foils in sequence, such that they fuse in sequence. The disadvantage of this system is that every wire or foil must be separately connected to an electrical circuit. This adds complexity. In addition complete testing of this device is not possible because, once actuated the foil strips are destroyed.

Thus, it is a primary object of the invention to provide a system for securing the segments of a structure together and to provide for separation of the segments.

It is another primary object of the invention to provide a system for securing the segments of a structure together and to provide for the separation of the segments in a sequential manner.

It is a further object of the invention to provide a system for securing the segments of a structure together and to provide for separation of the segments without significant shock loads being introduced into the structure.

It is a still further object of the invention to provide a system for securing the segments of a structure together and to provide for separation of the segments that can be tested prior to use and reset.

SUMMARY OF THE INVENTION

The invention is a separation system for releasably securing first and second structural members together along mating edges thereof. For example, the segments of a launch vehicle fairing used to protect the payload until orbit is reached. In detail, the invention includes a plurality of latches with each latch including a male portion mounted in proximity to the edge of the first structural member and a female portion mounted on the second structural member in proximity to the edge thereof. A locking device is mounted on the second structural member in proximity to the edge thereof, movable from a locked position securing the male portion to the female portion to a second position unlocking the male portion from the female portion. An actuation device is provided for sequentially moving the locking device of each latch from the first position to the second position, unlocking the male portions from the female portions of the plurality of latches.

The female portion of the latch includes a slot having inward directed protrusions at the entrance thereto. The male portion includes a pair of arms having first and second ends, the first ends pined to the first structure within the slot and the second ends having tangs. The arms are rotatable about the first end from a first position wherein the tangs are engaged with the protrusions of the female portion to a second position wherein the tangs are out of engagement with the protrusions. The locking means includes a pin movably mounted in the second structure, the pin movable from a first position wedged between the arms locking the arms in the first position, to a second position retracted from the arms such that they can move to their second position. A detente system is used to releasably hold the pin in either the first or second position.

The device for sequentially activating the locking devices includes a guide track mounted in the second structure in proximity to the edge thereof perpendicular to the movement of the pin. A cam block is slidably mounted in the guide track and includes a curved cam groove that exits from the first end a first distance from the edge of the second structure and a second end at second distance from the edge of the first structure, with the second distance greater than the first distance. The pin includes a cam follower protruding out one side thereof. A motor actuated cable system moves the cam block along the guide track such that as the cam follower of the pin enters the first end of the cam groove and exits from the second moving the pin from the first position to the second position allowing the male portion of the latch to disengage from the female portion.

The novel features which are believed to be characteristic of the invention, both as to its organization and method of operation, together with further objects and advantages thereof, will be better understood from the following description in connection with the accompanying drawings in which the presently preferred embodiment of the invention is illustrated by way of example. It is to be expressly understood, however, that the drawings are for purposes of illustration and description only and are not intended as a definition of the limits of the invention.

BRIEF DESCRIPTION OF THE DRAWINGS

FIG. 1 is a perspective view of the launch sequence of a booster rocket for placing a satellite in orbit.

FIG. 2 is an enlarged view of a portion of FIG. 1 illustrating the separation of the fairing from the satellite.

DESCRIPTION OF THE PREFERRED EMBODIMENT

Figure 3:
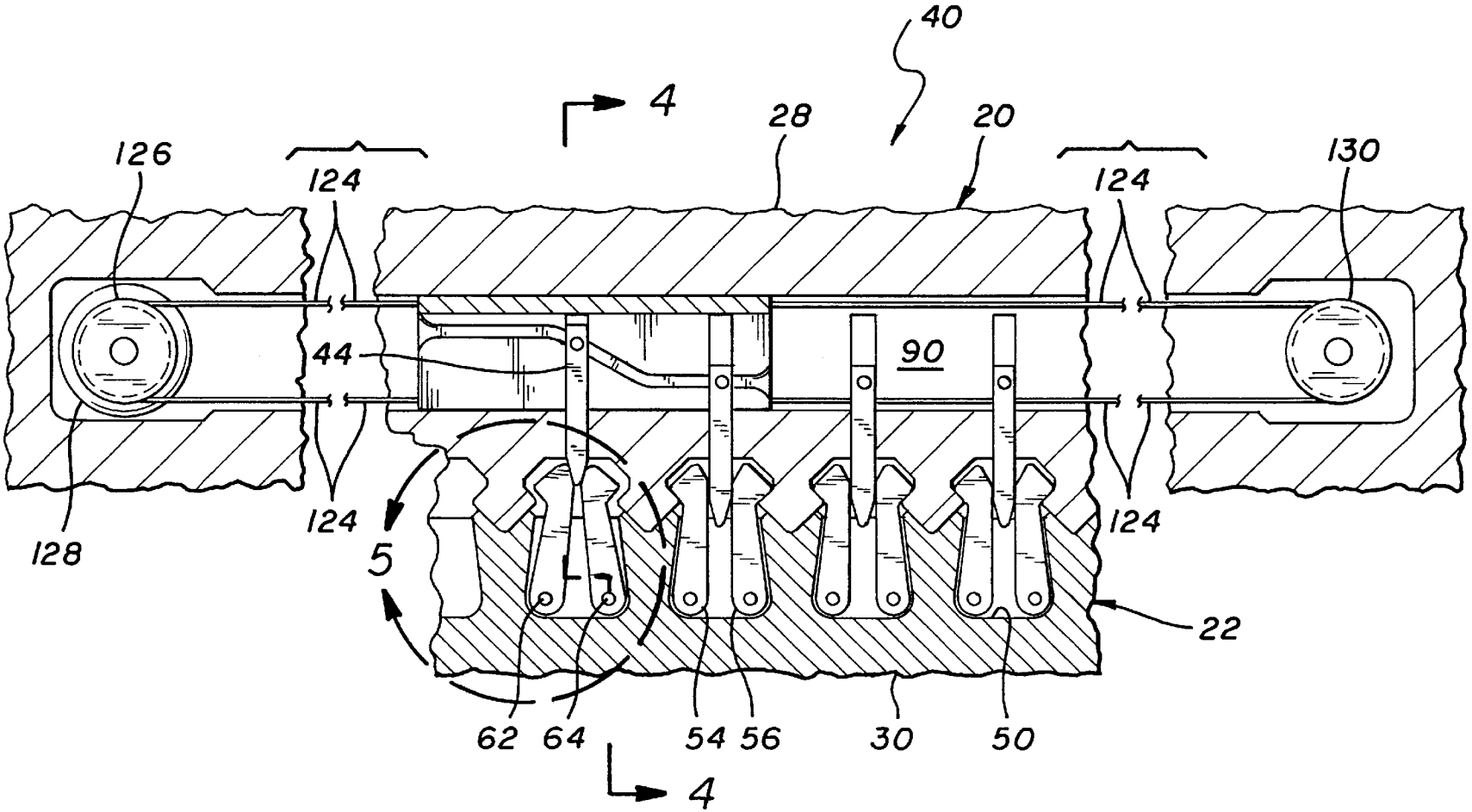
FIG. 3 is a partial side view of the faring shown in FIGS. 1 and 2 in the assembled position partially broken away to show the separation system for the fairing segments in the connected condition.

Referring to FIGS. 1 and 2, the typical launch vehicle, generally indicated by numeral 10, includes a first stage 12 and second stage 14 upon which is mounted a satellite 16 covered by a fairing assembly 17. The fairing assembly 17 is generally cone shaped having a bottom portion 18 and a nose 19. Typically two or more stages are necessary to place a satellite in orbit. Sometimes the satellite itself incorporates its own rocket engine to place it in a specific orbit. During takeoff and through final burnout of the second stage 14 extremely high loads are introduced into the fairing assembly 17 which are produced by aerodynamic forces as the launch booster accelerates through the atmosphere, as well as those induced by vibration loads induced by the propulsion system.

Referring to FIGS. 2–6, the fairing as illustrated comprises two fairing halves 20 and 22 having edge portions 24 and 26 that include a housing 28 having a protrusion 29 and a housing 30 having a mating groove 31, respectively, running along the periphery of the edge portions. Mounted at the base portion 18 and at the nose 19 are explosive fastener assemblies 31. These fastener assemblies 31 are well known in the art and need not be discussed further. Housing portion 30 includes a series of V shaped notches 32 along its length and housing portion 28 includes mating protrusions 34 along its length. Thus precise alignment of the fairing halves 20 and 22 can be accomplished when they are brought and held together in a joint that also provides shear strength. Mounted within each housing 28 and 30 are a plurality of release mechanisms 40, with the number varying depending upon the size of the fairing assembly 17. Each release mechanism 40 includes a male portion 42 mounted on the housing 30 of fairing half 22 and a female portion 44 mounted in housing 28 on the fairing half 20. The mechanisms 40 extend from the base portion 17, or in close proximity thereto, to as close to the nose 19 as physically possible. The degree to which the mechanisms 40 approach the nose 19 will generally depend upon the curvature of the fairing assembly 17.

The male portion 42 of the release mechanism 40 includes a notch 48 having a bottom end 50 with a greater width than the top end 52. A pair of arms 54 and 56 having first ends 58 and 60, respectively, are rotatably mounted by pins 62 and 64, respectively, at the bottom end 50 of notch 48 in a spaced relationship and biased toward each other by springs 65A and 65B. The arms 54 and 56 extend out of the notch 48 and terminate in second ends 66 and 68 having opposite facing tangs 70 and 72 mounted thereon. These tangs 70 and 72 have inward and outward facing chamfers 74 and 76, respectively. Thus the notch 48 controls the degree of rotation of the arms 54 and 56 away from each other.

The female portion 44 of the release mechanism 40 mounted in the housing portion 28 of fairing half 20 includes a slot 80 having inward facing protrusions 82 and 84 at the entrance thereto. These protrusions 82 and 84 have inward and outward facing chamfers 86 and 88, respectively. Note that chamfer 88 is part of the protrusion 34. Also located in the housing portion 28 mounted behind the notch is a slot 90 running perpendicular to the slot 80 over almost the entire length of the fairing half 20. A pin 92 is movably mounted in a bore 93 that extends from the slot 80 to the slot 90. The pin 92 includes two notches 94 and 96 and cam arms 97, the function of which will subsequently described. Mounted in the side of the slot 90 is a détente assembly 98 that releasably restrains the pin in the locking position shown in FIG. 4 to an unlocking position shown in FIG. 6. In the locking position, the pin 92 engages the arms 54 and 56 driving them apart and causing the tangs 70 and 72 to engage the protrusions 82 and 84 on the slot 80 locking the arms 54 and 64 and thus fairing to half 20 to the fairing half 22. In the unlocked position, the pin 92 is withdrawn from the arms 54 and 56 and the arms are free to rotate toward each other out of engagement with the protrusions 82 and 84. The chamfered surfaces 86 and 88 on the protrusions 82 and 84 and chamfers 76 and 78 on the tangs 70 and 72 allow the tangs 70 and 72 to move into and out of contact with the protrusions 82 and 84 with relative ease.

Releasably locking of the pin 92 is accomplished by a détente 98 mounted in the housing 28 having a first bore 102 in communication with a larger second bore 102A forming a shoulder 103. A rounded end pin 104 having a shoulder portion 105 is movably mounted within the bore 102A such that the rounded end 103 protrudes out the first bore 102. A spring 106 biases the pin 104 toward the pin 92. Thus in operation, as the pin 92 is moved from the locking position shown in FIG. 4 to the unlocking position shown in FIG. 5 détente 98 releasably holds the pin in place by engaging holes 94 and 96 therein. As will be subsequently discussed, this allows for complete separation of the fairing halves 20 and 22.

A cam block 110 is slidably mounted in the slot 90 incorporating a slot 111 for receiving the pin 92. A cam groove 112 having first and second ends 114 and 116. The cam groove 112 has a first portion 118 starting at first end 114 inline with the cam arms 97 on the pin 92 when the pin is in the unlocking position shown in FIG. 6, and a second portion 120 starting at second end 116 wherein the cam groove 112 is aligned with cam arm 97 when the pin 90 is in the locking position shown in FIG. 4. The in between portion 122 of the cam groove 112 is smoothly curved between the two. The cam block 110 is connected to an endless cable 124 connected to a drum 126 driven by electric motor 128. The cable 124 is attached to first end 116 wound about drum 126 mounted at the base 122 of the fairing 20 and extends to a pulley 130 mounted near the nose 19 of the fairing. Note while two cam grooves are shown for purposes of illustration, a single cam groove and single cam arm could be used.

Figure 4:
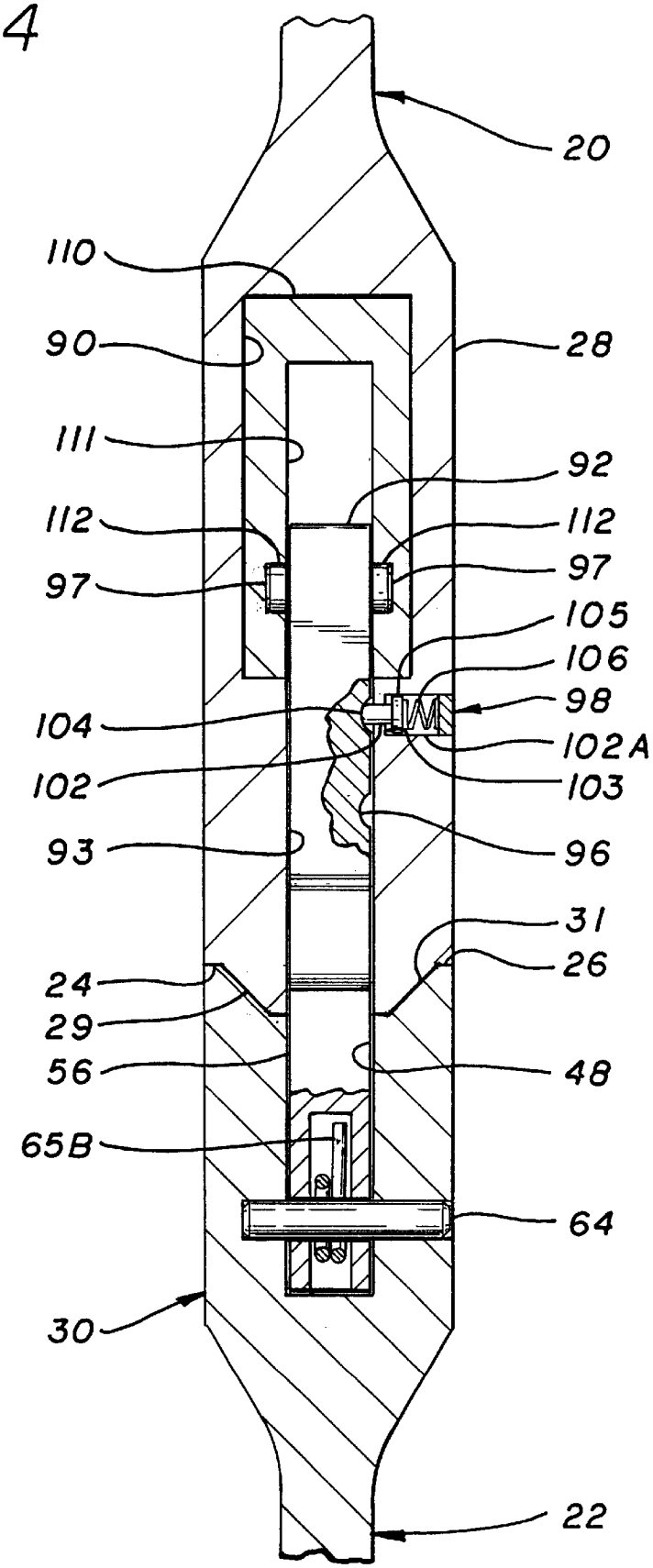
FIG. 4 is a cross-sectional view of FIG. 3 taken along the line 4—4.
Figure 5:
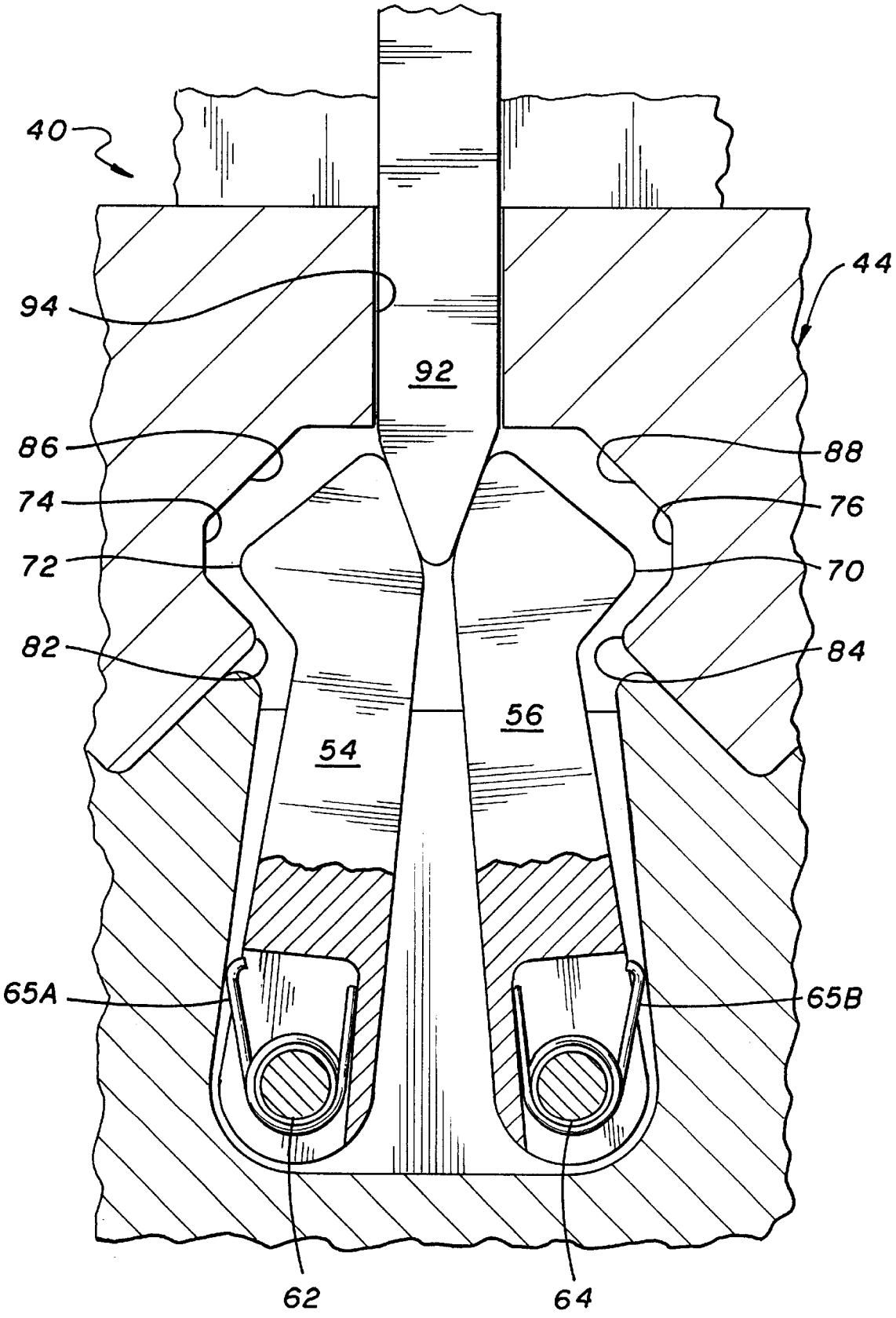
FIG. 5 is an enlarged view of a portion of FIG. 4.
Figure 6:
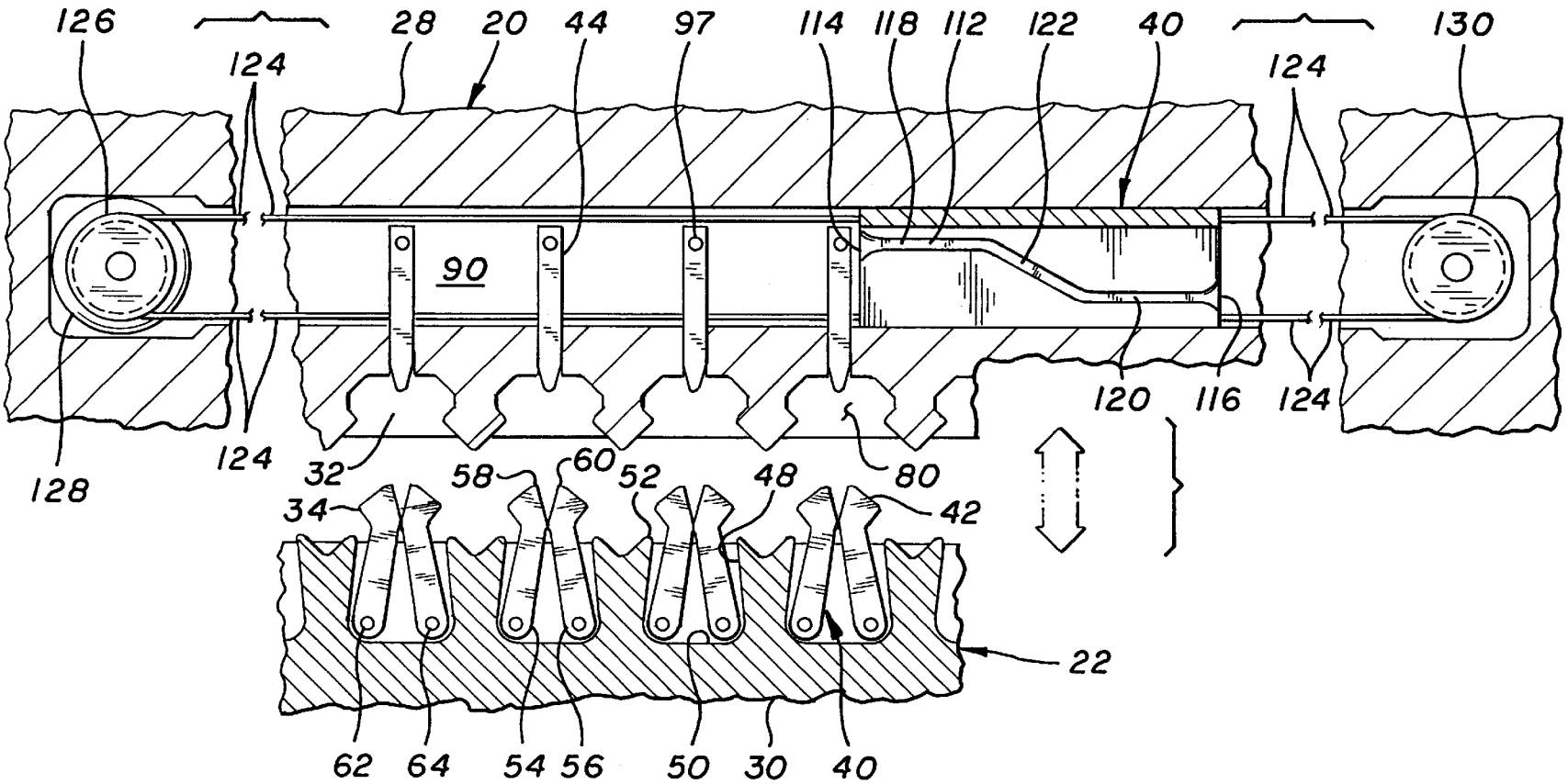
FIG. 6 is a view similar to FIG. 3 illustrating the fairing segments in the separated condition.

Thus with the latch mechanisms 40 in the latched position shown in FIG. 3, and 4, the motor 128 is actuated rotating the drum 126 to rotate causing the cable 124 to translate. This, in turn, causes the cam block 110 to translate. Because all the pins 92 are in the locking position shown in FIG. 4, the cam arm 97 will be "captured" by the first portion 116 of the cam grooves 112. As the cam block 110 translates the pin 92 is moved o the unlocked position shown in FIG. 6 as the cam arm enters the second portion 118 of the, cam groove 112, releasing the arms 54 and 56. Of course, reversing the motor 128 will cause the opposite effect. The drum 126 will rotate in the opposite direction causing the cam block 110 to translate in the opposite direction. Because all the pins 92 are in the unlocking position shown in FIG. 6, the cam arm 97 will be "captured" by the second portion 120 of the cam grooves 112. As the cam block 110 translates, the pin 92 is moved to the locked position shown in FIG. 4, as the cam arm 97 enters the first portion 120 of the cam groove 112, locking the tangs 70 and 72 of arms 54 and 56 into contact with the protrusions 82 and 84 of the slot 80.

Referring to all the FIGS. 1 through 6, when the second stage 14 of the launch vehicle 10 reaches orbit and the second stage propulsion system has terminated operation, the fairing assembly is no longer subjected to aerodynamic loads. At this point the release mechanisms 40 can be actuated to the unlatched positions. Thereafter, low shock producing explosive or non explosive actuated fastener assemblies 31 can be actuated allowing the fairing halves 20 and 22 to separate. Thus it can be seen that the subject invention provides a secure and complete joining of the fairing halves 20 and 22, zero shock unlatching, and can be tested prior to launch. The number of explosive actuated fastener assemblies has been reduced to a minimum.

While the invention has been described with reference to a particular embodiment, it should be understood that the embodiment is merely illustrative as there are numerous variations and modifications, which may be made by those skilled in the art. Thus, the invention is to be construed as being limited only by the spirit and scope of the appended claims.

Industrial Applicability

The invention has applicability to the aerospace industry.

What is claimed is:

1. An automated mechanical separation system for releasably securing first and second structural members of a space vehicle together along mating edges thereof, comprising:

a plurality of latches, each latch comprising:

a male portion mounted in proximity to the edge of the first structural member;

a female portion mounted in proximity to the edge of the second structural member; and a locking means mounted on one of the first and second structural members in proximity to the edge thereof, movable from a locked position securing said male portion to said female portion to an unlocked position unlocking said male portion from said female portion; and an automated mechanical assembly comprising means for sequentially moving said locking means of said plurality of latches from said locked position to said second position, to sequentially unlock said plurality of latches by a relative movement between each said male portion relative to its corresponding said female portion.

2. The separation system as set forth in claim 1 comprising:

said female portion comprising a slot having inward directed protrusions at the entrance thereto;

said male portion comprising a pair of arms having first and second ends, said first ends pined to the first structure and said second ends having tangs; said arms rotatable about said first end from an engaged position wherein said tangs are engaged with said protrusions of said female portion to an unengaged position wherein said tangs are out of engagement with said protrusions; and said locking means includes a pin movably mounted in the second structure, said pin movable from a first position wedged between said arms locking said arms in said first position, to a second position wherein said arms can move to their second position.

3. The separation system as set forth in claim 2 wherein said means for sequentially moving said locking means comprises:

a guide track mounted in the first structure in proximity to the edge thereof perpendicular to the movement of said pin;

a cam block having first and second ends, said cam block slidably mounted in said guide track, said cam block having a curved cam groove; said cam groove exiting said first end of said cam, block at a first distance from the edge of the second structure and a second end at a second distance from the edge of the first structure,. said second. distance being greater than said first distance;

said pin having a cam follower protruding out one side thereof, and means to move said cam block along said guide track such that as said cam follower enters said first end of said cam groove and exits from said second end of said cam groove said pin is moved from said first position to said second position.

4. The separation system as set forth in claim 3 wherein said means to move said cam block along said guide track includes an electric motor having a real mounted thereto; and a cable, having first and second ends, said first end attached to said cam block and said second end attached to said real, such that rotation of said real by said motor causes said cam block to move along said cam track.

5. The separation system as set forth in claim 4 comprising detente means for releasably holding said pin in said first and second positions.

6. The separation system as set forth in claim 1 wherein substantially zero shock is produced in the separation system when the plurality of latches are sequentially unlocked.

7. An automated mechanical separation system for releasably securing first and second structural members of a space vehicle together along mating edges thereof, comprising:

a plurality of latch assemblies, wherein each of the plurality of latch assemblies comprises:

a pair of arms having first ends pined in proximity to an edge of the first structural member and second ends having tangs;

a slot mounted in proximity to an edge of the second structural member having inward directed protrusions;

a pin mounted on the second structural member and movable between the arms to a latched position engaging the tangs with the protrusions and movable away from the arms to an unlatched position unengaging the tangs from the protrusions; and a cam follower protruding out one side of the pin; and an automated mechanical assembly to sequentially unlatch and latch the plurality of latch assemblies comprising:

a guide track in proximity to the edge of the first structural member and perpendicular to the movement of the pin;

a cam block slidably mounted in the guide track, the cam block having a curved cam groove exiting a first end of the cam block a first distance from the edge of the second structural member and exiting a second end of the cam block a second distance from the edge of the first structural member, wherein the second distance is greater than the first distance; and means for moving the cam block along the guide track such that the cam follower enters the first end of the cam groove and exits the second end of the cam groove to move the pin from the latched position to the unlatched position.

8. The separation system as set forth in claim 7 wherein the means for moving the cam block along the guide track comprises:

an electric motor having a real mounted thereto; and a cable having a first end attached to the cam block and a second end attached to the real, such that rotation of the real by the motor causes the cam block to move along the guide track.

9. The separation system as set forth in claim 7 comprising:

détente means for releasably holding the pin in the latched and unlatched positions.

10. The separation system as set forth in claim 7 wherein substantially zero shock is produced in the separation system when the plurality of latch assemblies are unlatched and latched in sequence.

* * * * *

UNITED STATES PATENT AND TRADEMARK OFFICE

CERTIFICATE OF CORRECTION

PATENT NO. : 6,557,475 B1
DATED : May 6, 2003
INVENTOR(S) : Nygren et al.

It is certified that error appears in the above-identified patent and that said Letters Patent is hereby corrected as shown below:

Column 6,
Line 36, after the punctuation mark “,”, delete the punctuation mark “.”;
Line 37, after the word “second”, delete the punctuation mark “.”;
Line 56, delete the word “detente”, and insert therefor -- détente --.

Signed and Sealed this

Twenty-sixth Day of August, 2003

JAMES E. ROGAN
*Director of the United States Patent and Trademark Office*